United States Patent [19]

Love et al.

[11] Patent Number: 4,718,448

[45] Date of Patent: Jan. 12, 1988

[54] GAS VALVE

[75] Inventors: John J. Love, St. Louis; Carl F. Fernstrom, Marlborough, both of Mo.

[73] Assignee: Emerson Electric Co., St. Louis, Mo.

[21] Appl. No.: 37,072

[22] Filed: Apr. 13, 1987

Related U.S. Application Data

[63] Continuation of Ser. No. 842,892, Mar. 24, 1986, abandoned.

[51] Int. Cl.[4] ..... F17D 3/03

[52] U.S. Cl. ..... 137/271; 137/599.1; 137/613

[58] Field of Search ..... 137/599, 599.1, 613, 137/269, 271; 251/117; 261/18.3

[56] References Cited

U.S. PATENT DOCUMENTS

| | | | |
|---|---|---|---|
| 607,252 | 7/1898 | Lunken | 137/271 |
| 1,804,462 | 5/1931 | Eggleston | 251/117 |
| 2,924,387 | 2/1960 | Hajny | 137/613 X |
| 3,090,423 | 5/1963 | Garner et al. | 158/125 |
| 3,496,951 | 2/1970 | Stang et al. | 137/269 X |
| 3,666,048 | 5/1972 | Zajaczkowski | 137/269 X |
| 3,741,242 | 6/1973 | Hansen et al. | 137/269 X |
| 3,941,144 | 3/1976 | Cornil | 137/599.1 X |
| 4,374,785 | 2/1983 | Wyatt | 251/117 X |
| 4,424,830 | 1/1984 | Arnsperger et al. | 137/613 |
| 4,425,930 | 1/1984 | Kruto | 137/599 |
| 4,524,033 | 6/1985 | Elledge | 261/18.3 |

FOREIGN PATENT DOCUMENTS

| | | | |
|---|---|---|---|
| 217877 | 12/1983 | Japan | 137/599.1 |

OTHER PUBLICATIONS

"White-Rodgers Technical Sales Bulletin", Bulletin No. 188, dated Mar. 30, 1973, p. 8.

*Primary Examiner*—Martin P. Schwadron
*Assistant Examiner*—Stephen M. Hepperle
*Attorney, Agent, or Firm*—Paul A. Becker, Sr.

[57] ABSTRACT

A gas valve for providing two levels of flow capacity to a burner is adapted to enable easy conversion of the valve from use with one type of gas to use with another type. To this end, a low-flow passageway, which establishes the low-flow capacity, is sized to provide the desired low-flow capacity when the valve is used with one type of gas. An opening, axially aligned with the passageway, receives a screw means which simply prevents the escape of gas to the exterior of the valve. When the valve is to be converted to use with another type of gas having a higher BTU content, the pressure regulator and burner orifice screw are changed, and the screw means in the axially aligned opening is replaced with a metering screw means which, in addition to preventing the escape of gas, has a portion which extends into the low-flow passageway so as to reduce the effective opening area of the low-flow passageway.

2 Claims, 7 Drawing Figures

GAS VALVE

This application is a continuation of application Ser. No. 842,892, filed Mar. 24, 1986, now abandoned.

BACKGROUND OF THE INVENTION

This invention relates to gas valves, and particularly to gas valves which provide two levels of flow capacity to a burner.

SUMMARY OF THE INVENTION

An object of this invention is to provide a generally new and improved gas valve which provides two levels of flow capacity to a burner, and which is particularly simple and economical in construction.

A further object is to provide such a valve which is easily converted from use with one type of gase, such as natural gas, to use with another type of gas, such as LP (liquified petroleum).

The above-mentioned and other objects and features of the present invention will become apparent from the following description when read in conjunction with the accompanying drawings.

DESCRIPTION OF THE PREFERRED EMBODIMENT

The gas valve of this invention, except for the construction which provides for two levels of fuel flow, is very similar to the gas valve shown and described in U.S. Pat. No. 4,424,830. In describing the present invention, some details of construction not pertinent to an understanding of the present invention are omitted for the sake of brevity. Reference may be made to the above patent for such details.

Figure 1:
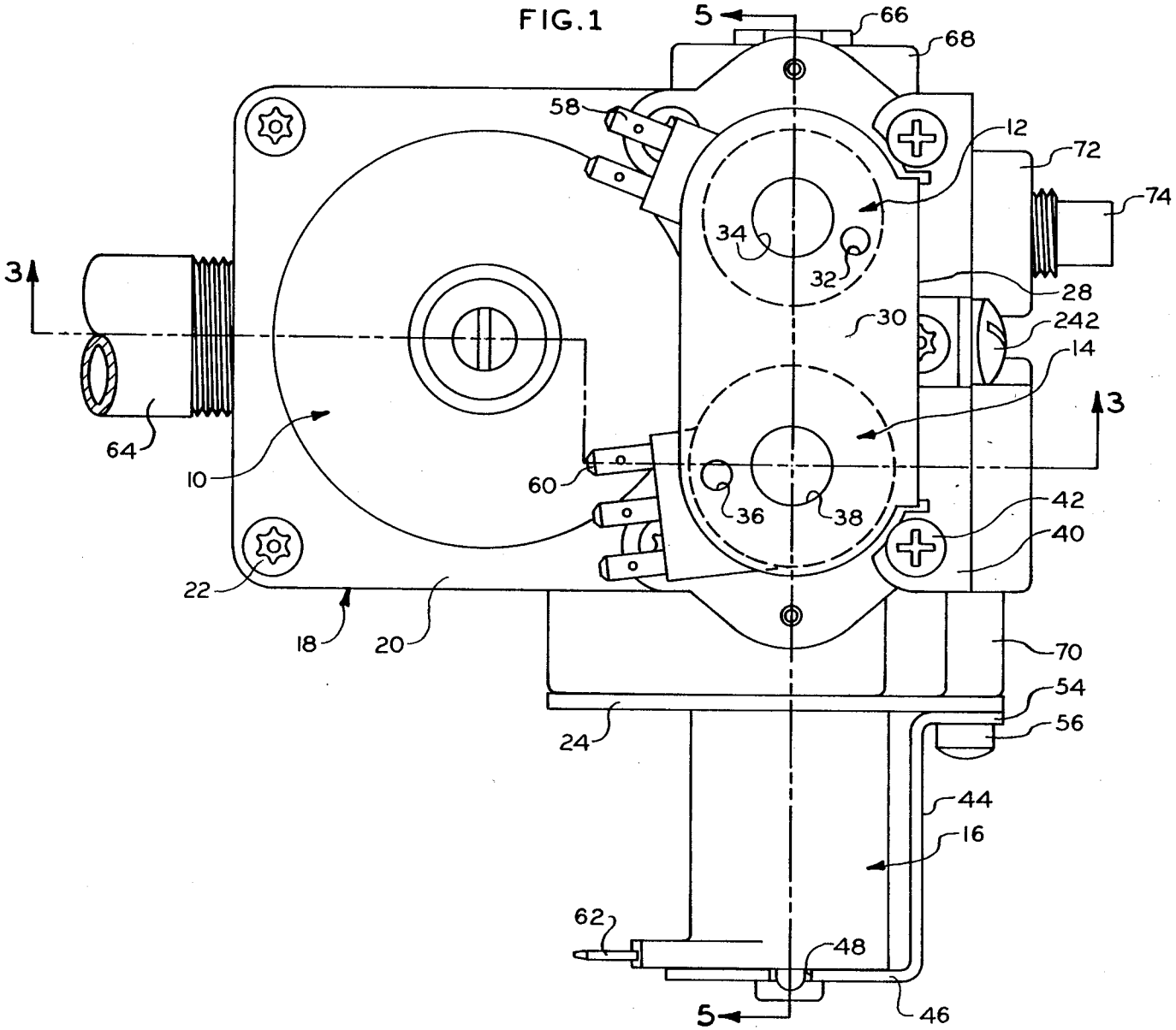
FIG. 1 is a top plan view of the gas valve constructed in accordance with the present invention.
Figure 2:
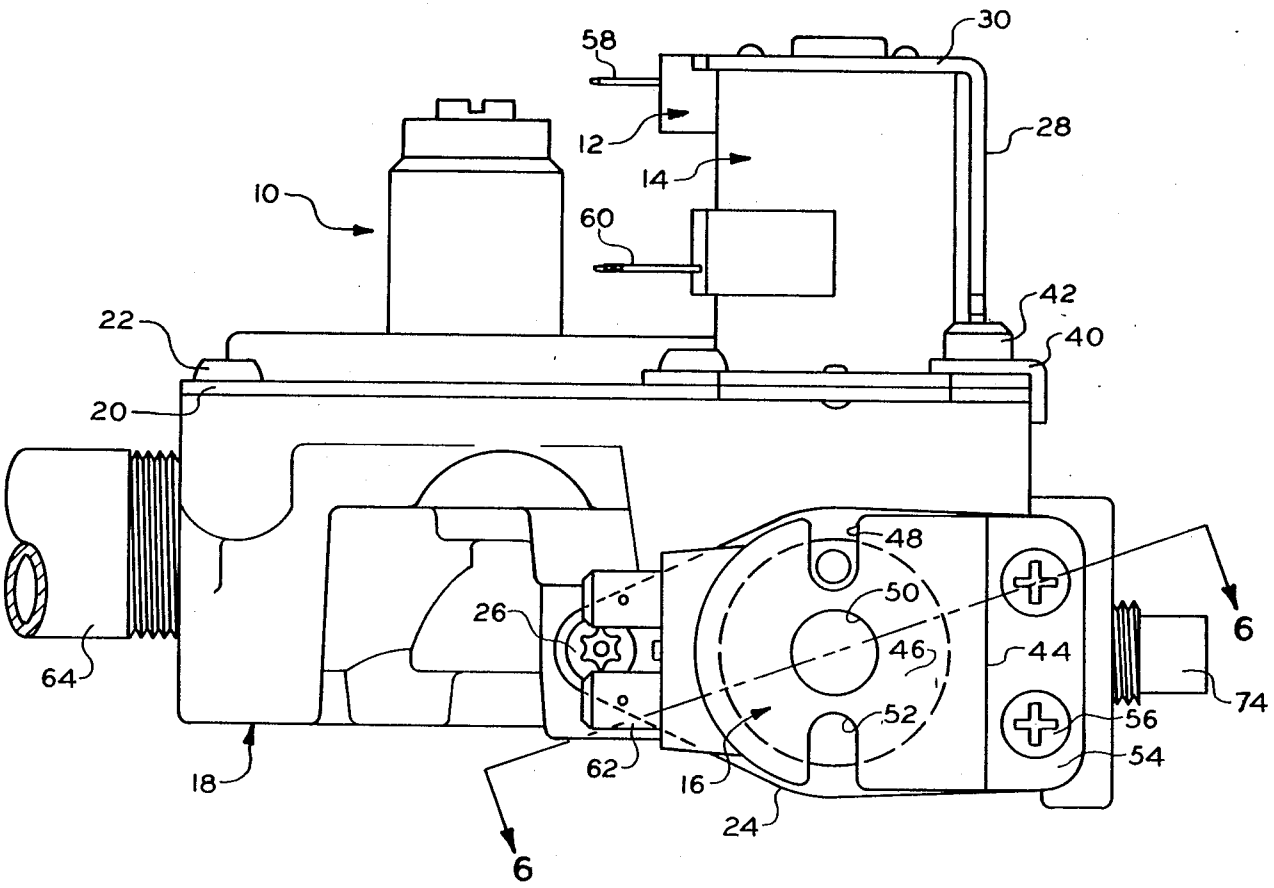
FIG. 2 is a front elevation view of the gas valve of FIG. 1.

Referring to FIGS. 1 and 2, the gas valve of this invention includes a pressure regulator indicated generally at 10 and three solenoid operated valves indicated generally at 12, 14, and 16 positioned on a valve body indicated generally at 18. A top cover plate assembly 20, cooperative with regulator 10 and solenoid operated valves 12 and 14, is attached to valve body 18 by a plurality of tamperproof screws 22. A side cover plate 24, cooperative with solenoid operated valve 16, is attached to valve body 18 by a plurality of counter-sunk tamper-proof screws 26, one of which is shown in FIG. 2.

Solenoid operated valves 12 and 14 are secured to valve body 18 by a bracket 28. A top leg 30 of bracket 28 is provided with apertures 32 and 34 through which portions of valve 12 extend, and with apertures 36 and 38 through which portions of valve 14 extend. A bottom leg 40 of bracket 28 is secured by screws 42 to valve body 18. Solenoid operated valve 16 is secured to valve body 18 by a bracket 44. A top leg 46 of bracket 44 is provided with apertures 48 and 50 through which portions of valve 16 extend, and with an unused aperture 52. A bottom leg 54 of bracket 44 is secured by screws 56 to valve body 18.

Solenoid operated valves 12, 14, and 16 are provided with a plurality of tab terminals 58, 60, and 62, respectively, for connection thereof to the electrical control system (not shown).

Gas flows into valve body 18 via a gas inlet conduit 64 and exits valve body 18 to a burner (not shown) through an orifice screw 66 threadedly engaged in an outlet boss 68 of valve body 18. Axially aligned with outlet boss 68 and extending from the side of valve body 18 opposite outlet boss 68 is a boss 70 to which solenoid operated valve 16 is secured. Extending from the side of valve body 18 opposite the side to which gas inlet conduit 64 is attached is another boss 72 in which a pressure tap fitting 74 is threadedly engaged.

Figure 3:
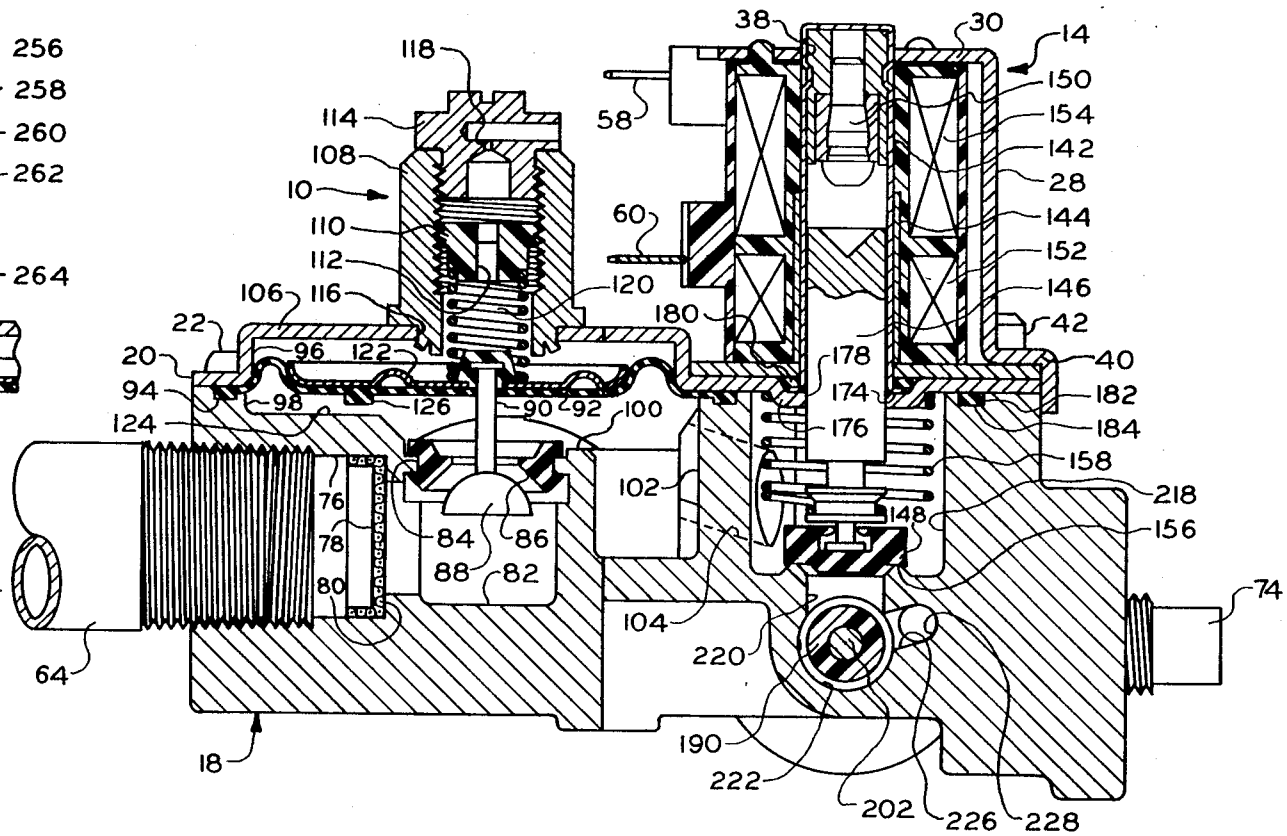
FIG. 3 is a cross-sectional view taken along line 3—3 of FIG. 1.

Referring to FIG. 3, valve body 18 is provided with a threaded and stepped opening 76 for receiving inlet conduit 64. A small-mesh screen 78 is located against a shoulder 80 in opening 76 downstream of inlet conduit 64 for trapping any foreign particles, such as dirt or metal chips, that may be present in the gas stream. Contiguous with opening 76 is a chamber 82, one end of which is provided with ledge 84 to which a valve seat 86 is attached.

Pressure regulator 10 is effective to control the rate of gas flow out of chamber 82. Regulator 10 includes a poppet valve 88 cooperative with valve seat 86 and connected by a valve stem 90 to a flexible diaphragm 92.

A peripheral portion of diaphragm 92 is located in a groove 94 of valve body 18 and is sandwiched between valve body 18 and top cover plate assembly 20. Diaphragm 92 forms a flexible wall between an upper chamber 96 and a lower chamber 98 of regulator 10. Lower chamber 98 is defined by diaphragm 92 and a recess formed in valve body 18, the recess having a bottom wall 100 and a side wall 102 having a passageway 104.

The upper chamber 96 of regulator 10 is defined by diaphragm 92 and a recess formed by a cup-shaped portion 106 of top cover plate assembly 20, an internally-threaded sleeve 108, a spring-adjusting screw 110 having a centrally located aperture 112 therein, and a fixed-orifice screw 114. Sleeve 108 is staked to cup-shaped portion 106 at a centrally located aperture 116 therein. Screw 114 is threadedly attached to the interior of sleeve 108 and is provided with a small-diameter opening 118 to cause upper chamber 96 to be exposed to atmospheric pressure. Screw 110 is threadedly attached to the interior of sleeve 108 and enables adjustment of a spring 120 which biases diaphragm 92 downwardly. A relatively rigid disc 122 is centrally positioned and attached to diaphragm 92. Disc 122 aids in securing valve stem 90 to diaphragm 92, provides a rigid nesting surface for one end of spring 120, and imparts rigidity to diaphragm 92.

Valve body 18 in lower chamber 98 is provided with three peripherally spaced bosses 124 projecting upwardly from bottom wall 100. These bosses 124 limit downward movement of diaphragm 92 so as to ensure that diaphragm 92 will not restrict or throttle the gas flow past valve seat 86 when gas pressure is relatively low. The underside of diaphragm 92 is provided with three projections 126 which are vertically aligned with bosses 124. These projections, which further limit downward movement of diaphragm 92, also prevent damage to the relatively thin diaphragm 92 that could otherwise occur due to vibration when diaphragm 92 and bosses 124 are normally in contact, such as during shipment of the valve.

In operation, under normal inlet gas pressure, regulator valve 88 is biased downwardly, in reference to FIG. 3, to permit the desired rate of gas flow to the burner. If the inlet pressure increases, the increased pressure acts against diaphragm 92 so as to move valve 88 upwardly. The resulting smaller opening between valve 88 and its seat 86 acts to maintain essentially the same rate of gas flow at the burner. If the inlet pressure decreases, diaphragm 92 and valve 88 are forced downwardly by spring 120. The resulting larger opening between valve 88 and its seat 86 acts to again maintain essentially the same rate of gas flow at the burner.

Figure 5:
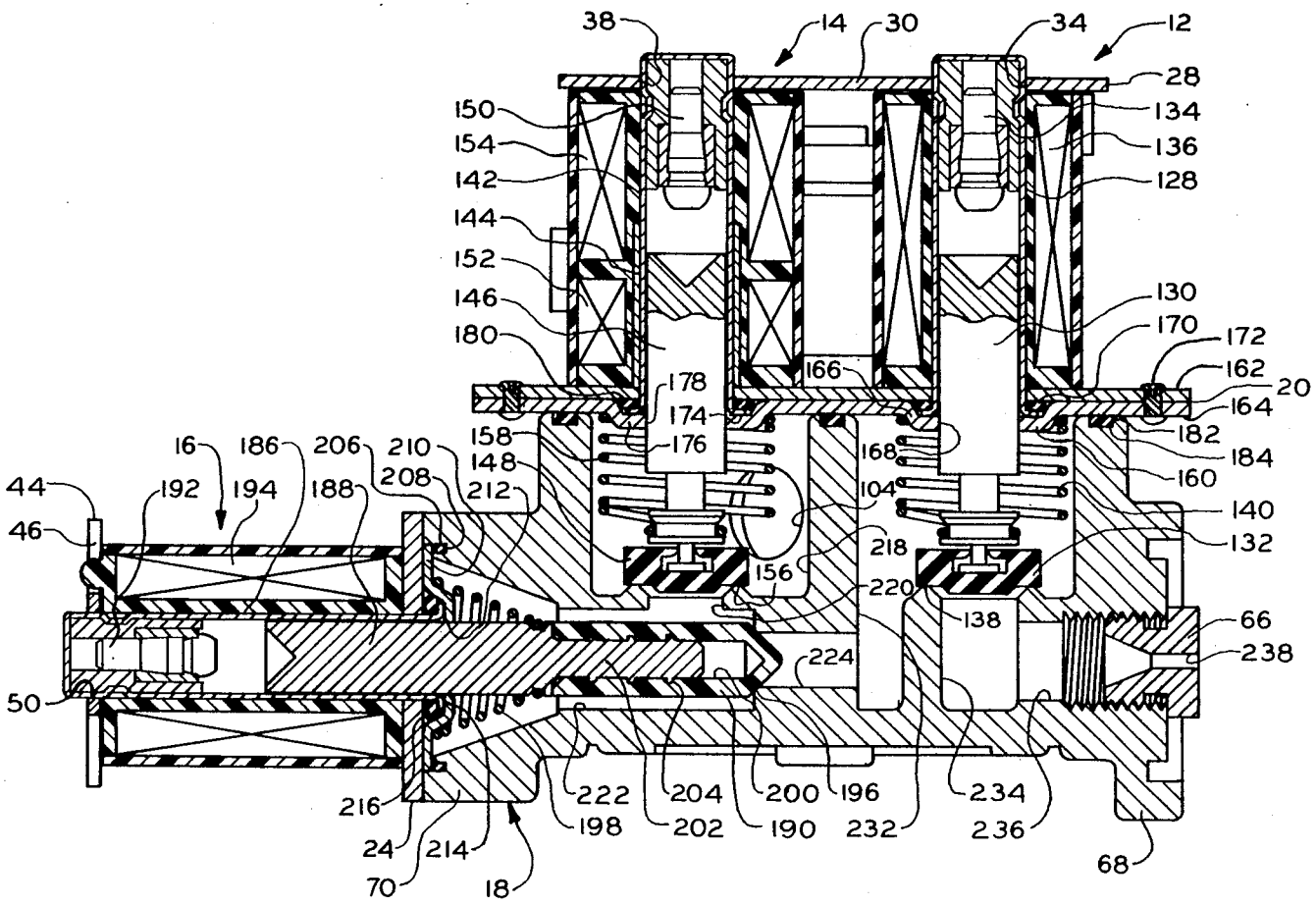
FIG. 5 is a cross-sectional view taken along line 5—5 of FIG. 1.

Referring to FIG. 5, solenoid operated valve 12 comprises a guide sleeve 128, a slidably mounted plunger 130 to which a valve 132 is attached, a plunger stop member 134, and an electrical winding 136. Valve 132 cooperates with a valve seat 138 in valve body 18 and is biased to its closed position by a spring 140. Valve 132 is moved to an open position when winding 136 is energized.

Solenoid operated valve 14 comprises a guide sleeve 142, a temperature compensating sleeve 144, a slidably mounted plunger 146 to which a valve 148 is attached, a plunger stop member 150, and a pair of electrical windings 152 and 154. Valve 148 cooperates with a valve seat 156 in valve body 18 and is biased to its closed position by a spring 158. Valve 148 is moved to an open position when both windings 152 and 154 are energized.

In solenoid operated valve 12, the upper end of guide sleeve 128 extends through aperture 34 in top leg 30 of bracket 28. The lower end of guide sleeve 128 is flared outwardly at 160 to accommodate a gas-sealing resilient mounting of guide sleeve 128 to top cover plate assembly 20. Specifically, top cover plate assembly 20 comprises two plates 162 and 164. Plate 162 is flat whereas plate 162 has a cup-shaped portion 166 with a centrally located aperture 168 through which plunger 130 extends. A compressible O-ring 170 is sandwiched between the flared end 160 of guide sleeve 128 and plate 162. The vertical spacing between plate 162 and the cup-shaped portion 166 of plate 164 is somewhat less than the combined thickness of flared end 160 and O-ring 170 in its uncompressed state so that when plates 162 and 164 are connected together, as by rivets 172, the O-ring 170 is compressed so as to provide the desired gas-sealing resilient mounting of guide sleeve 128.

In the same manner, the upper end of guide sleeve 142 of solenoid operated valve 14 extends through aperture 38 in top leg 30 of bracket 28, and the lower end of guide sleeve 142 is flared outwardly at 174. Plate 164 includes another cup-shaped portion 176 with a centrally located aperture 178 through which plunger 146 extends. An O-ring 180 is sandwiched between the flared end 174 of guide sleeve 142 and plate 162.

As previously described, top cover plate assembly 20 is secured to valve body 18 by a plurality of tamper-proof screws 22. Located in a groove 182 of valve body 18 and sandwiched between valve body 18 and top cover plate assembly 20 is a gas-sealing, compressible ring 184. Preferably, groove 182 is contiguous with groove 94, which retains diaphragm 92, and ring 184 is integral with diaphragm 92.

Referring to FIG. 5, solenoid operated valve 16 comprises a guide sleeve 186, a slidably mounted plunger 188 to which a valve 190 is attached, a plunger stop member 192, and an electrical winding 194. Valve 190 cooperates with a valve seat 196 in valve body 18 and is biased to its closed position by a spring 198. Valve 190 is moved to an open position when winding 194 is energized.

Valve 190 comprises an elongated cylindrical member having an aperture 200 therein. One end 202 of plunger 188 is provided with a plurality of barbs 204. Plunger end 202 is press-fitted into aperture 200, barbs 204 ensuring a rigid connection between plunger 188 and valve 190.

Boss 70 of valve body 18 is provided with a stepped groove 206 for receiving a gasket 208 and a cup-shaped plate 210. Plate 210 is provided with a centrally located aperture 212 through which plunger 188 of solenoid operated valve 16 extends. The upper end of guide sleeve 186 of valve 16 extends through aperture 50 in top leg 46 of bracket 44, and the lower end thereof is flared outwardly at 214. A compressible O-ring 216 is sandwiched between the flared end 214 of guide sleeve 186 and plates 210 and 24. The depth of the stepped groove 206 and the vertical spacing between plates 210 and 24 are such that, when plate 24 is secured to valve body 18, gasket 208 and O-ring 216 provide the desired gas-sealing function.

Referring to FIG. 5, passageway 104, which leads from lower chamber 98 of regulator 10, is contiguous with a chamber 218 formed as a recess in valve body 18. The top of chamber 218 is defined by top cover plate assembly 20. A bottom wall of chamber 218 is provided with a passageway 220 having valve seat 156 formed at the entrance thereof. Valve 148 of solenoid operated valve 14 cooperates with valve seat 156 to control the flow of gas between chamber 218 and passageway 220.

Figure 6:
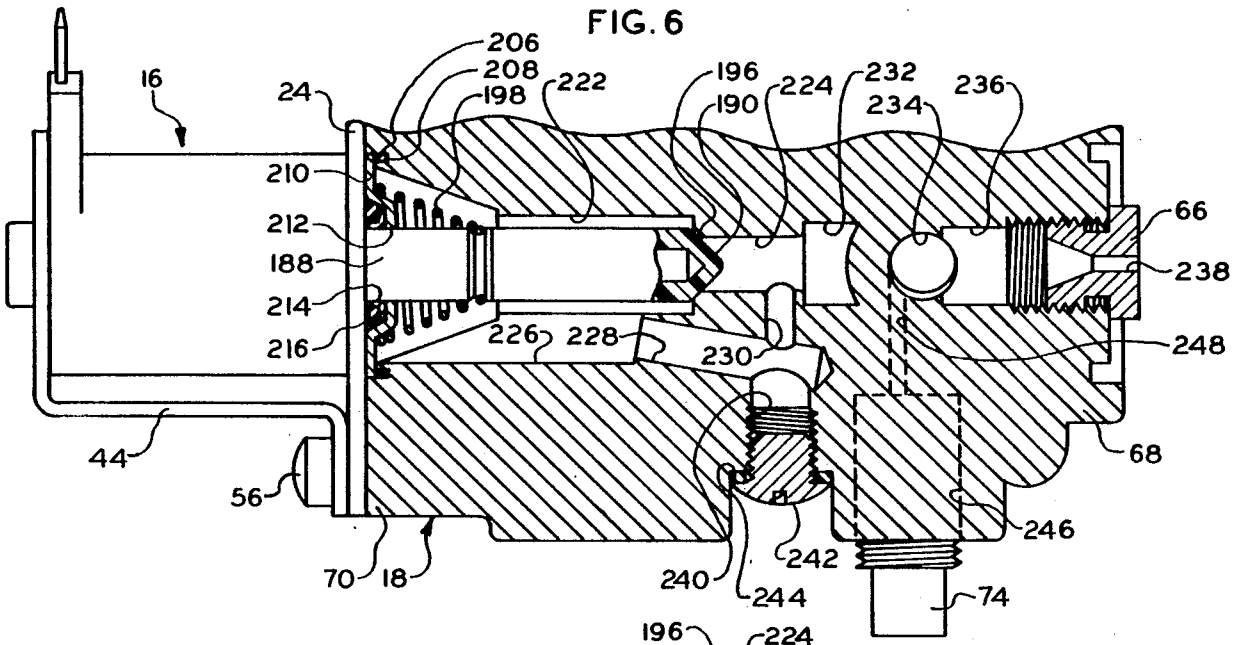
FIG. 6 is a cross-sectional view taken along line 6—6 of FIG. 2.

Referring to FIGS. 5 and 6, passageway 220 is contiguous with a chamber 222 which is defined at one end by plate 210. The other end of chamber 222 is provided with a passageway 224 having valve seat 196 formed at the entrance thereof. Chamber 222 is in constant communication with passageway 224 through passageways 226, 228, and 230 which bypass the flow path past valve 190 and its seat 196.

Passageway 226 is a cored passageway laterally spaced from and contiguous with chamber 222. Passageway 228 is a drilled passageway extending from passageway 226. Passageway 230, also drilled, is the smallest of the three passageways and extends from passageway 228 to passageway 224.

Passageway 224 is contiguous with a chamber 232 formed as a recess in valve body 18. The top of chamber 232 is defined by top cover plate assembly 20. A bottom wall of chamber 232 is provided with a passageway 234 having valve seat 138 formed at the entrance thereof. Valve 132 of solenoid operated valve 12 cooperates with valve seat 138 to control the flow of gas between chamber 232 and passageway 234. Passageway 234 is contiguous with a passageway 236 in which orifice screw 66, having a small-diameter opening 238, is threadedly engaged.

Axially aligned with passageway 230 is an opening 240 leading from passageway 228 to the exterior of valve body 18. A screw 242, with an underlying gas-sealing gasket 244, is threadedly engaged in passageway 240.

Pressure tap fitting 74 is threadedly engaged in a passageway 246 which is in communication with passageway 234 via a passageway 248.

Solenoid operated valve 16 is energized whenever a full or maxiumum flow of gas is desired; valve 16 is de-energized whenever a low or minimum flow of gas is desired. Solenoid operated valves 12 and 14 are energized when either full flow or minimum flow is desired.

Specifically, when full flow is desired, valves 12, 14, and 16 are energized, and gas flows from inlet conduit 64 through opening 76, chamber 82, past regulator valve 88 and its seat 86, into regulator chamber 98, through passageway 104, chamber 218, past valve 148 and its seat 156, through passageway 220, into chamber 222, past valve 190 and its seat 196, through passageway 224, chamber 232, past valve 132 and its seat 138, through passageways 234 and 236, and through opening 238 in orifice screw 66 to the burner. Gas also flows in a bypass path parallel to the path from chamber 222 to passageway 224 past valve 190 and its seat 196, the bypass parallel path being from chamber 222 through passageways 226, 228, and 230.

When low flow is desired, valves 12 and 14 are energized and valve 16 is de-energized. With valve 16 de-energized, its valve 190 is seated on its seat 196 so that gas flow is then restricted to the bypass flow path from chamber 222 through passageways 226, 228, and 230. Passageways 230 is sufficiently small in diameter as to effect a smaller gas flow to the burner under this low-flow condition as compared to the full-flow condition wherein valve 190 is open. For example, a typical construction provides for a full-flow which provides 30,000 BTUs and a low-flow which provides 20,000 BTUs.

A salient feature of the present invention is that the valve can be easily converted from use with natural gas to use with LP. To enable the valve to be used with LP, three valve components must be changed. First, the pressure regulator 10 must be changed so as to cause its valve 88 to be held in an open position. This is done since LP is regulated at the LP tank and thus does not need to be regulated in the valve. Second, the gas flow capacity of the low-flow bypass path provided by passageways 226, 228, and 230 must be reduced. This reduction is necessary because of the higher BTU content of LP as compared to natural gas. Third, orifice screw 66, which leads to the burner, must be changed to an orifice screw having a smaller-diameter opening than the opening 238 of orifice screw 66. This, again, is required because of the higher BTU content of LP.

Figure 4:
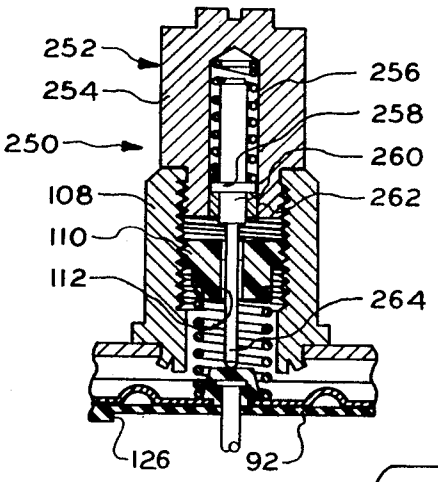
FIG. 4 is a partial cross-sectional view illustrating the regulator construction when the gas valve is converted to use with LP.

Referring to FIG. 4, shown generally at 250 is the regulator construction when the valve is to be used with LP. Regulator 250 is established simply by removing screw 114 from regulator 10 and installing a screw assembly indicated generally at 252. Screw assembly 252 includes a screw 254 having external threads for threaded engagement to the interior of sleeve 108. Screw 254 is centrally apertured to receive a spring 256 and an enlarged head portion 258 of a blocking pin 260. A sleeve 262 is press-fitted in the aperture of screw 254 to retain blocking pin 260. Blocking pin 260 includes a smaller diameter portion 264 which extends downwardly through aperture 112 of spring-adjusting screw 110. Blocking pin 260 is dimensioned so that when screw assembly 254 is installed, the bottom tip of pin portion 264 contacts diaphragm 92 and forces it downwardly to cause valve 88 to open the desired amount. The various parts are so dimensioned that, when the parts are within the dimensional tolerances, valve 88 is sufficiently open and spring 256 biases the enlarged head portion 258 of blocking pin 260 against sleeve 260. Should the dimensions be such that diaphragm 92 is forced downwardly to the point where its projections 126 are forced against bosses 124, blocking pin 264 is thereafter forced upwardly, compressing spring 256, so as to prevent further downward movement of diaphragm 92.

Referring to FIG. 6, when the valve is to be converted to use with LP, orifice screw 66 is removed and a different orifice screw, with a smaller-diameter opening than opening 238, is installed.

Figure 7:
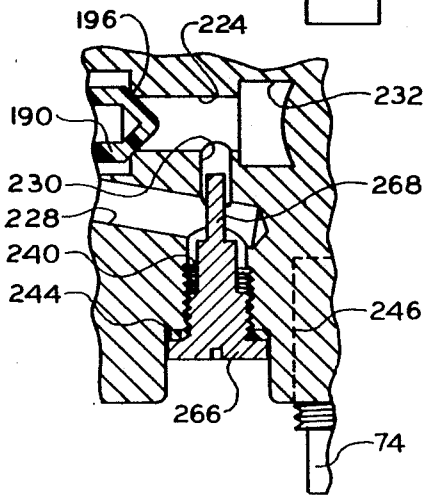
FIG. 7 is a partial cross-sectional view illustrating a metering screw arrangement when the gas valve is converted to use with LP.

Referring to FIGS. 6 and 7, when the valve is to be converted to use with LP, screw 242 is removed and a metering screw 266 is installed. Screw 266 includes a cylindrical end portion 268 which extends into passageway 230 so as to reduce the effecting opening area of passageway 230. The diameter of end portion 268 is such that it reduces the gas flow capacity through passageway 230 to the amount required to effect the desired low-flow capacity for use with LP.

The illustrated axial alignment of passageway 230 and opening 240, resulting in end portion 268 of screw 266 entering passageway 230 in the direction of the centerline of passageway 230, ensures that, even if end portion 268 is not perfectly centered in passageway 230, the effective opening area between end portion 268 and passageway 230 remains constant.

While a preferred embodiment of the present invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a gas valve for selectively providing low-flow and full-flow rates of gas flow to a burner, a valve body having an inlet and an outlet;

a first solenoid operated valve for controlling flow of gas from said inlet to a chamber;

a passageway downstream of said chamber having a valve seat at the entrance thereto;

a second solenoid operated valve including a valve member cooperative with said valve seat;

a third solenoid operated valve for controlling flow of gas from said passageway downstream of said chamber to said outlet;

low-flow passageway means providing constant communication between said chamber and said passageway downstream of said chamber so that, when only said first and third valves are energized, the low-flow rate of gas flows to said outlet, said second valve being effective, when energized, to permit gas to flow past said valve member and said valve seat so that, when said first, second, and third valves are energized, gas flow past said valve member and said seat combines with gas flow through said low-flow passageway means to establish the full-flow rate of gas flow to said outlet, said low-flow passageway means including a drilled passageway, said valve body including a threaded opening axially aligned with said drilled passageway; and screw means threadedly engaged in said threaded opening for effecting the value of said low-flow rate of gas flow and being selectable so that said gas valve is convertible from use with one type of gas to use with another type of gas, said screw means comprising, when said gas valve is used with said one type of gas, a screw which terminates exteriorly of said drilled passageway, and said screw means comprising, when said gas valve is used with said another type of gas, a screw which is cooperative with said drilled passageway for reducing said low-flow rate of gas flow.

2. The gas valve claimed in claim 2 wherein said screw which is cooperative with said drilled passageway includes a cylinderical end portion which extends into said drilled passageway so as to reduce the effective opening area of said drilled passageway.

* * * * *